United States Patent [19]

Leng et al.

[11] Patent Number: 4,597,660

[45] Date of Patent: Jul. 1, 1986

[54] HIGH SPEED COPYING MACHINE

[75] Inventors: Svay Leng; Saburo Suganuma; Hiroyuki Kataoka, all of Kanagawa, Japan

[73] Assignee: Fuji Xerox Co., Ltd., Tokyo, Japan

[21] Appl. No.: 356,543

[22] Filed: Mar. 9, 1982

[30] Foreign Application Priority Data

Mar. 12, 1981 [JP] Japan ..... 56-34633

[51] Int. Cl.[4] ..... G03G 21/00; G03G 15/16

[52] U.S. Cl. ..... 355/3 SH; 355/3 TR

[58] Field of Search ..... 355/3 SH, 3 TR, 14 SH, 355/3 R

[56] References Cited

U.S. PATENT DOCUMENTS

| | | | |
|---|---|---|---|
| 4,025,187 | 5/1977 | Taylor et al. | 355/3 SH |
| 4,203,663 | 5/1980 | Ogura et al. | 355/3 SH |
| 4,260,241 | 4/1981 | Honma et al. | 355/3 SH |

*Primary Examiner*—R. L. Moses

*Attorney, Agent, or Firm*—Sughrue, Mion, Zinn, Macpeak, and Seas

[57] ABSTRACT

A high speed copying machine transports a sheet from a sheet stack to a stop gate at very high speed, and then transports the sheet from the stop gate to a transfer point on the drum at a speed matching the peripheral speed of the drum. The time required to rotate a point on the drum from the exposure position to the transfer point is actually greater than the time required to transport a sheet from the sheet stack to the stop gate, which is very near the transfer point.

7 Claims, 1 Drawing Figure

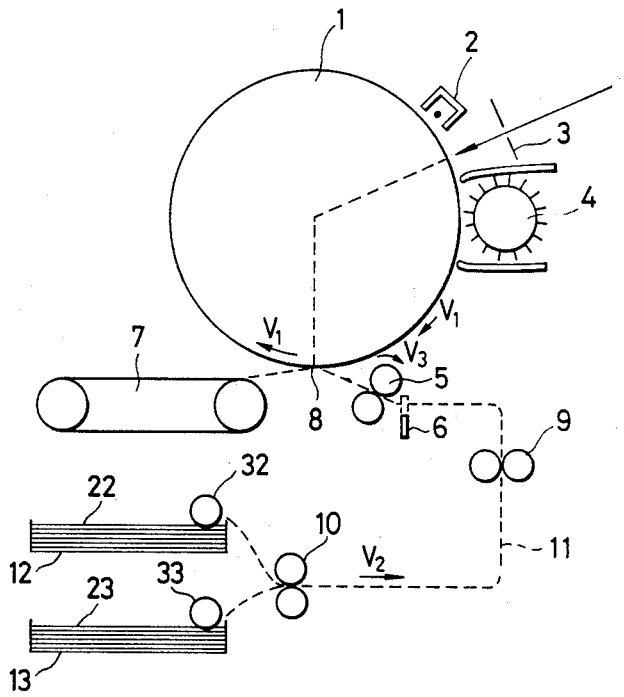
1
2
3
4
7
$V_1$
$V_1$
$V_3$
5
8
6
9
32
22
10
11
12
$V_2$
33
23
13

HIGH SPEED COPYING MACHINE

BACKGROUND OF THE INVENTION

This invention relates to a high speed copying machine.

In a conventional copying machine, because of the structural arrangement thereof, it is difficult to place a sheet containing tray near the photo-sensitive drum; i.e., the tray is positioned away from the photo-sensitive drum. Furthermore, in order to readily allow the position of a sheet to coincide with the position of a latent image on the photo-sensitive drum, the circumferential speed of the photo-sensitive drum is set equal to the sheet conveying speed.

Accordingly, the conventional copying machine suffers from the drawback that the copying time required for obtaining the first copy (or the first output) is long. Furthermore, since the sheet conveying speed is maintained unchanged irrespective of the sizes of sheets, the copying efficiency is low in the case where the sheets are small in size. This is another drawback accompanying the conventional copying machine.

SUMMARY OF THE INVENTION

An object of this invention is to provide a high speed copying machine obtained by improving the arrangement of a conventional copying machine so that the above-described drawbacks are eliminated, to increase copying efficiency and reduce the loss of the operation time.

The foregoing object has been achieved by the provision of a high speed copying machine wherein the sheet conveying speed is higher than the circumferential speed of the photo-sensitive drum.

BRIEF DESCRIPTION OF THE DRAWINGS

The sole drawing FIGURE is a schematic diagram showing the one embodiment of the present invention.

DETAILED DESCRIPTION OF THE PREFERRED EMBODIMENTS

FIG. 1 is a schematic diagram showing one embodiment of the invention. In FIG. 1, reference numeral 1 designates a photo-sensitive drum; 2, a charge corotron; 3, a one dimensional slit provided for passing image-writing light; and 4, a developing unit. The components 2, 3 and 4 are provided near the photo-sensitive drum 1 in the stated order, in the direction of rotation of the drum 1.

Further in FIG. 1, reference numeral 5 designates register rolls disposed in a sheet conveying path 11 and immediately upstream of a point where a sheet meets the surface of the photo-sensitive drum 1, namely, a transfer point 8 where an electrostatic latent image formed on the photo-sensitive drum 1 is developed and transferred to the sheet. Reference numeral 6 designates a stop gate disposed on the sheet conveying path 11 and immediately upstream of the register rolls 5.

Further in FIG. 1, reference numeral 9 designates a pair of slip rolls provided in the sheet conveying path 11 and upstream of the stop gate 6; 10, a pair of common conveying rolls for conveying sheets of different sizes; 12 and 13, a first and second sheet containing trays which contain sheets 22 and 23 of different sizes, respectively; 32 and 33, sheet supplying rolls provided for the first and second sheet containing trays, respectively; 7, a transporter for sheets onto which an image has been transferred.

The sheet conveying speed $v_2$ is set higher than the circumferential speed $v_1$ of the photo-sensitive drum 1, which is set equal to the circumferential speed $v_3$ of the register rolls 5.

In addition, the sheet conveying speed $v_2$ is selected so that the period of time $t_1$ required for turning the photo-sensitive drum 1 from the position of the slit 3, or an exposure position, to the position of the transfer point is longer than the period of time $t_2$ required for transferring a sheet from the sheet containing tray 12 or 13 to the stop gate 6 ($t_1 > t_2$). If, in this case, the sheet conveying speed $v_2$ is excessively high, then a sheet will reach the stop gate before the rear edge of the preceding sheet passes through the stop gate, as a result of which the first sheet overlaps the second sheet. In order to prevent such a problem, it is necessary to determine the sheet conveying speed $v_2$ in agreement with the opening and closing timing of the stop gate.

With the high speed copying machine constructed as described above, a high speed copying operation is carried out as follows:

The image writing light is applied through the slit 3 to the photo-sensitive drum 1, which is uniformly charged by the charge corotron 2, and is turned at the circumferential speed $v_1$, so that an electrostatic latent image is formed thereon. The latent image is developed by the developing unit 4 as the photo-sensitive drum 1 turns in the direction of the arrow.

One of the two groups of sheets 22 and 23 of different sizes will have been selected by the operator. If the group of sheets 22 is selected by the operator, for instance, the conveying of the sheets 22 is started simultaneously when the electrostatic latent image is formed on the photo-sensitive drum 1. The sheet 22 is conveyed along the sheet conveying path 11 by the conveying rolls 10 at the speed $v_2$, higher than the circumferential speed $v_1$ of the drum 1.

Then, the sheet 22 is stopped by the stop gate 6 temporarily, so that it coincides, in timing, with the latent image on the photo-sensitive drum 1. In this operation, the slip rolls 9 operate to correct the posture of the sheet.

When the sheet 22 coincides, in timing, with the latent image, the stop gate 6 is opened, and simultaneously the register rolls 5 start rotation to convey the sheet 22 to the transfer point 8 on the photo-sensitive drum 1. In this case, the difference between the sheet conveying speed $v_2$ and the circumferential speed $v_3$ of the register rolls 5 is absorbed by the slip rolls 9. After the image has been transferred onto the sheet 22 at the transfer point 8, the sheet 22 is conveyed to the next process (not shown) by the transporter 7.

In a laser printer, latent images can be formed side by side, with no space therebetween, on the photo-sensitive drum. The employment of the copying mechanism according to the invention makes it possible to supply sheets side by side to the laser printer.

As is apparent from the above description, in the invention, the circumferential speed $v_1$ of the photo-sensitive drum, the sheet conveying speed $v_2$ and the speed of rotation $v_3$ of the register rolls are selected so as to satisfy the following expressions:

$$v_1 = v_3$$
$$v_1 < v_2$$

In addition, the sheet conveying speed $v_2$ is so set that the period of time $t_1$ required for the photo-sensitive drum 1 to turn from the exposure position corresponding to the position of the slit 3 to the transfer point is longer than the period of time $t_2$ required for a sheet to move from the sheet containing tray to the stop gate ($t_1 > t_2$).

Furthermore, the stop gate is provided immediately donwstream of the register rolls on the sheet conveying path, so that a sheet coincides, in timing, with a latent image on the photo-sensitive drum, i.e., the sheet meets the latent image at the transfer point. Thus, the invention has a significant effect in that a high speed copying machine high in copying efficiency and lower in time loss can be provided.

The sheet conveying speed is quite high. Therefore, it is another effect of the invention that, even in the case where the distance between the photo-sensitive drum and the sheet containing tray is long, the copying time required for obtaining the first copy (or the first output) is short.

What is claimed is:

1. A high speed copying machine, comprising:

a photo-sensitive drum having a transfer point thereon;

a sheet containing tray;

releasable stop means provided between said tray and said transfer point;

first feed means for conveying sheets from said stop means along a predetermined sheet conveying path to said transfer point on said photo-sensitive drum at a speed equal to the peripheral speed of said drum; and second feed means for conveying sheets from said tray to said stop means at a speed greater than the peripheral speed of said drum to ensure positioning of a sheet against said stop means prior to release of said stop means when movement of a sheet from said tray and movement of said transfer points are initiated simultaneously.

2. A copying machine as claimed in claim 1, further comprising a charge corotron and a developing unit arranged along the outer wall of said drum and in the direction of rotation of said drum, prior to said transfer point.

3. A copying machine as claimed in claim 2, further comprising exposure slit means arranged between said corotron and said developing unit.

4. A copying machine as claimed in claim 1, wherein said first feed means is composed of a pair of rolls arranged immediately upstream of said transfer point on said sheet conveying path.

5. A copying machine as claimed in claim 4, said stop means comprising a stop gate arranged upstream of said drum and immediately upstream of said pair of rolls for feeding sheets to said drum.

6. A copying machine as claimed in claim 1, further comprising a pair of slip rolls provided upstream of said stop means.

7. A copying machine as claimed in claim 5, further comprising slip rolls provided upstream of said stop gate.

* * * * *